US005994674A

United States Patent [19]

Carter

[11] Patent Number: 5,994,674

[45] Date of Patent: Nov. 30, 1999

[54] HOB

[75] Inventor: Maurice Hugh Carter, Peterborough, United Kingdom

[73] Assignee: GDA Applied Energy Limited, United Kingdom

[21] Appl. No.: 08/833,321

[22] Filed: Apr. 4, 1997

Related U.S. Application Data

[63] Continuation-in-part of application No. 08/532,668, Nov. 29, 1995, abandoned.

[30] Foreign Application Priority Data

Apr. 13, 1993 [GB] United Kingdom ..... 9307608

[51] Int. Cl.[6] ..... H05B 3/68

[52] U.S. Cl. ..... 219/452.11; 219/460.1

[58] Field of Search ..... 219/443, 457, 219/463, 464, 407

[56] References Cited

U.S. PATENT DOCUMENTS

| | | | |
|---|---|---|---|
| 2,179,934 | 11/1939 | Jones | 219/464 |
| 2,870,316 | 1/1959 | Ferguson, Jr. | 219/464 |
| 3,316,390 | 4/1967 | Gaugler et al. | 219/464 |
| 3,345,498 | 10/1967 | Siegla | 219/464 |
| 3,346,721 | 10/1967 | Bassett, Jr. | 219/464 |
| 3,348,025 | 10/1967 | Bassett, Jr. et al. | 219/464 |
| 3,355,575 | 11/1967 | Bassett, Jr. et al. | 219/464 |
| 3,423,572 | 1/1969 | Pansing | 219/464 |
| 3,501,621 | 3/1970 | Pansing et al. | 219/464 |
| 3,885,128 | 5/1975 | Dills . | |

FOREIGN PATENT DOCUMENTS

| | | |
|---|---|---|
| 2 277 145 | 4/1993 | United Kingdom . |
| 2 294 317 | 10/1994 | United Kingdom . |

*Primary Examiner*—Teresa Walberg
*Assistant Examiner*—Sam Paik
*Attorney, Agent, or Firm*—Kirschstein, et al.

[57] ABSTRACT

A hob comprises a substantially planar member having apertures defining hotplate regions, a glass-ceramic insert being positioned in each aperture above a radiant heating element. The use of a molded glass insert corresponding to a hotplate region offers several advantages over prior art hobs conventionally comprising a glass-ceramic sheet formed by a flat glass process which extends over a plurality of hotplate regions. Another embodiment consists of a drop-in heating unit for a hob comprising a metal can, a substrate, a resilient annular spacer, a radiant heating element and a molded glass-ceramic insert. An over-temperature thermal limiter acts to prevent the unit becoming overheated. A metal compression band extends around a downwardly protruding skirt of the insert, increasing its resistance to shock. The glass-ceramic insert has reinforcing radial spars and a profile which generally has a greater thickness of glass towards its periphery and a generally lesser thickness towards its center, the transition being provided by a curved profile. Such shaping of the insert improves both its transmissive and its conductive properties without a reduction in strength.

11 Claims, 5 Drawing Sheets

HOB

This is a continuation-in-part of U.S. application Ser. No. 08/532,668, filed Nov. 29, 1995, now abandoned.

BACKGROUND OF THE INVENTION

The present invention relates to hobs of the type which employ radiant heating elements, and heating units therefor.

It is desirable that the heat output of a hob responds quickly to the setting control. This is one reason for the popularity of gas appliances where the change in heat output occurs substantially simultaneously with the change in setting. With regard to electric hobs, this desire for a quick response time has resulted in the gradual trend, initially from solid plate to spiral elements, and more recently to hobs comprising a glass-ceramic top plate, commonly referred to as ceramic hobs, using radiant heating elements, such as tungsten halogen lamps, or inductive heating units. Apart from a quick response time over conventional solid plate and spiral type hobs, ceramic hobs also give the advantage of being easy to clean and are aesthetically pleasing, normally comprising four or more heating units mounted under a single sheet of glass-ceramic.

In order to provide at least one hotplate surface in an otherwise conventional solid plate hob with the rapid response time afforded by glass-ceramic hobs, it has been proposed by the present inventors to produce glass-ceramic "drop-in" units which could be substituted for one or more of the solid plate elements. This is disclosed in UK Patent Nos. GB 2177578B and GB 2138935B.

SUMMARY OF THE INVENTION

In accordance with a first aspect of the present invention there is provided a hob comprising: a substantially planar member having at least one aperture therein defining a hotplate region; a substantially planar glass-ceramic insert located in the aperture and a radiant heating element below the glass-ceramic insert, the glass-ceramic insert being molded.

The present invention retains the advantages provided by a conventional ceramic hob, either incorporating a tungsten halogen or inductive heating source, of fast response time and easy cleaning. However, the inventors have realized that by employing a hob in accordance with the present invention significant other advantages are obtained. By using molded glass-ceramic inserts, a number of features can be incorporated into the hob which would not be possible using glass-ceramic material formed in sheets by the float glass or other process. Also, less glass-ceramic material is used which material is expensive relative to materials used for the member, such as enamelled steel or a suitable worksurface material.

For the avoidance of doubt, if any, the phrase "molded glass-ceramic insert" includes inserts made by molding glass which is then heat treated to change the structure of the glass to that of a glass-ceramic. One such material would be lithium-alumino-silicate.

One advantage of moulding the insert is that the lower surface of the insert can advantageously be molded such as to form a lens for modifying the radiation pattern through the insert, to provide a desired heat distribution over the surface of the hotplate region. Advantageously, this lens is a Fresnel lens enabling the lowermost surface of the insert to remain substantially planar, thereby avoiding increasing the depth of the insert.

Preferably, the insert is molded to support a temperature sensitive element, substantially the whole of the temperature sensitive region of the element preferably being held in thermal contact with the insert. This enables the heating element to then be controlled in dependence on the temperature of the glass-ceramic insert instead of on the resistance of the heating element or over-temperature protection or thermal cut-out device conventionally mounted below the hotplate of a ceramic hob.

Preferably, the insert comprises a temperature sensitive element which in use is connected to a control circuit that regulates the radiant heating element in dependence on the output of the temperature sensitive element. The temperature sensitive element is preferably formed by a region of the glass-ceramic material of the insert, electrodes electrically connected to the control means being formed on the insert defining a region of the insert which is the temperature sensitive element. The glass-ceramic material is a poor electrical conductor, the resistance of which is temperature dependent. By forming electrodes on the insert, it is possible to control the heating element directly in dependence upon the resistance and therefore temperature of the glass. The electrodes would normally be closely spaced because of the poor resistive nature of the glass-ceramic, but this ensures the resistive value is not significantly altered by a conductive metal cooking utensil being placed on the upper surface of the insert. The region of the insert forming the temperature sensitive region can have material diffused therein in order to modify the conductive properties of that region.

Preferably, the temperature sensitive element comprises a temperature sensitive conductive strip deposited on the insert.

The electrodes, or conductive strip of the preferred features mentioned above are preferably deposited by screen printing, pad printing or by a spray deposition method.

The advantage of having a temperature sensitive element directly on the glass ceramic material or formed in that material is that it eliminates the need for both control means for the normal operation of the heating element, often achieved by monitoring the current in the heating elements, and an over-temperature protection device located conventionally just below the glass-ceramic layer of a conventional ceramic hob. It is therefore preferable that the control means is electrically connected to the temperature sensitive element and arranged such as to control both the normal heating function of the radiant heating element and also ensure the maximum safe operating temperature of the glass-ceramic insert is not exceeded.

Advantageously, there is a seal between the insert and the member, which seal is formed from a mixture of alumina/glass fibre and a silicone sealant. Such a mixture prevents the ingress of water or dirt below the insert, and also provides a high resistance to abrasion when the surface is cleaned.

Advantageously, the hob further comprises a metal can mounted below said insert for supporting said heating element, wherein the insert has a downward protruding annular ridge, or skirt, by means of which the metal can is located, thereby ensuring that the metal can is correctly centered relative to the insert.

Preferably, the member supports resilient mounting means which urge the metal can in which the heating element is supported towards the insert, the metal can comprising thermally insulating material which is arranged such that this is urged into contact with the insert. In this way, the mass of the thermal insulating material and metal can provides damping to any shock force experienced by the glass, but by being mounted to the member itself does not provide an excessive upward force on the insert relative to the insert in response to the member being depressed. Preferably, the member comprises a downwardly protruding annular shelf about the aperture, the shelf supporting the insert and the resilient mounting means such that the attachment of the resilient mounting means to the shelf is obscured from view by the insert.

Advantageously, the glass-ceramic is thermo-chromic as this provides a visual indication that the glass-ceramic is hot even though the hob may be turned off.

The inventors have found also that improvement of the ceramic-glass insert is possible, especially with regard to the volume of glass-ceramic used, and hence cost per insert, and to the thermal conduction properties of the insert.

In accordance with a second aspect of the present invention, there is provided a heating unit for a hob comprising: a container, a radiant heating element positioned within the container, and a molded glass-ceramic insert having a substantially planar upper surface and a lower surface shaped to reinforce the insert against damage from vertically applied forces.

Advantageously, the lower surface is shaped so as to generally have a greater thickness of glass towards its periphery and a generally lesser thickness towards its center wherein the transition from a greater to a lesser thickness is provided by a curved profile. By providing the insert with such a cross section, the central portion, through which portion it is desired to transmit the majority of heat, can be thinner than would be possible employing an insert of uniform thickness. It is not important that the insert has a thickness of glass greater than that at the center of the insert for the entire circumference of its periphery so long as there is generally a greater thickness of glass on its periphery relative to the center of the insert.

Preferably, the lower surface is shaped to form a plurality of radial reinforcing spars, which greatly increase the resistance to shattering of the insert on impact. The spars preferably meet at a central node. Such features have been found to also be aesthetically pleasing, which is an important factor in the design of a hob.

In accordance with a third aspect of the present invention, there is provided a heating unit for a hob comprising: a container, a radiant heating element positioned within the container, a molded glass-ceramic insert having a substantially planar upper surface and a lower surface having a downwardly protruding skirt formed thereon, and a metal band held in tension by such as to act to compress the skirt and thereby reinforce the insert against damage from vertically applied forces. Employing such a band has been found to greatly increase the resistance to shattering on impact of a mass dropped vertically on the insert.

Employing the second and third aspects of the present invention, the thickness of the glass-ceramic can be reduced which reduces the quantity of material required to produce the insert. More importantly, the reduced thickness considerably improves the thermal transmission properties of the glass, for it has been found that in addition to the attenuation of radiant transmission being reduced, conduction through the glass is greatly increased and this contributes significantly to the efficiency of the heating unit.

BRIEF DESCRIPTION OF THE DRAWINGS

Embodiments of the invention will now be described, by way of example only, with reference to the accompanying figures, in which like reference numerals are used throughout FIGS. 1 to 5 and FIGS. 6 to 10 respectively, and of which.

DETAILED DESCRIPTION OF THE PREFERRED EMBODIMENTS

Figure 1:
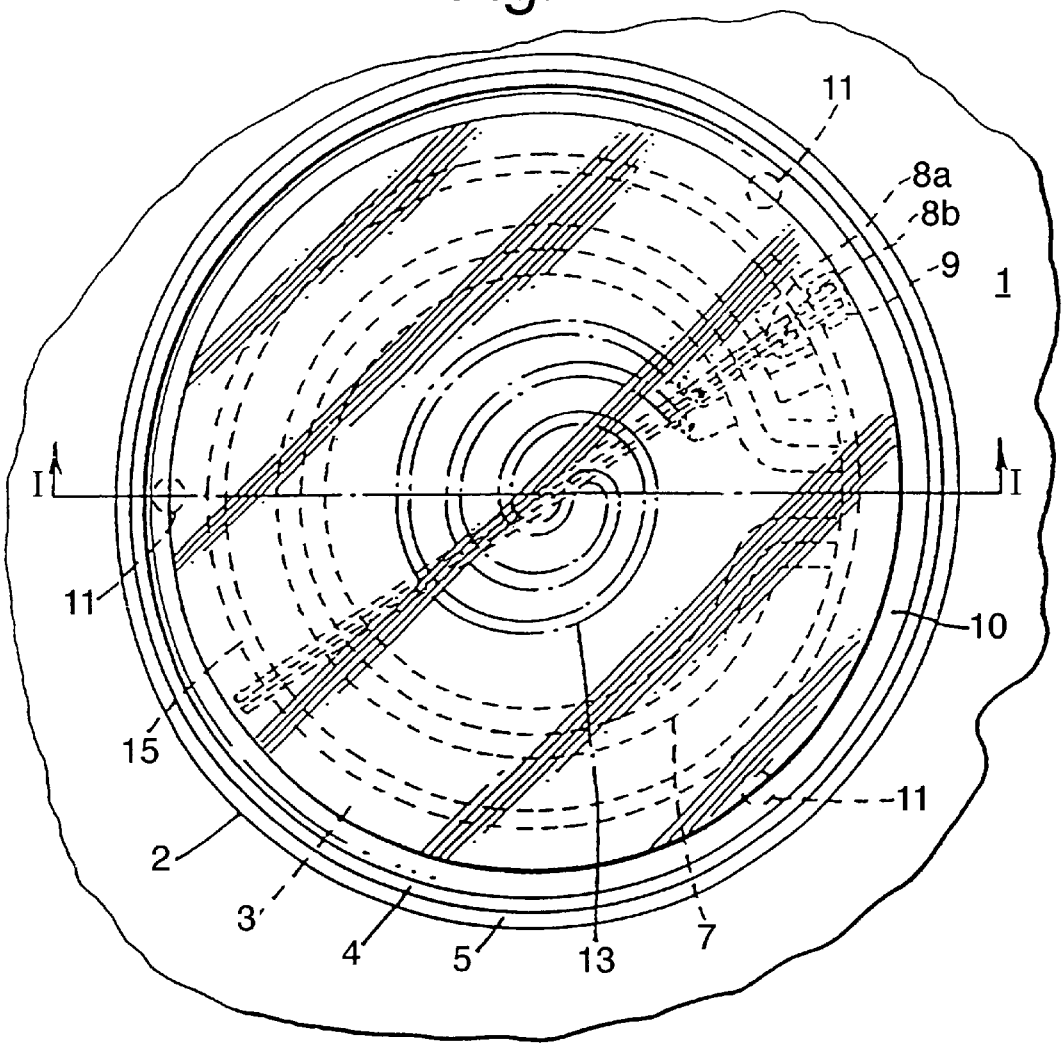
FIG. 1 is a schematic view of part of a hob in accordance with the present invention, in which those features partially obscured by the ceramic glass insert are shown in broken line.
Figure 2:
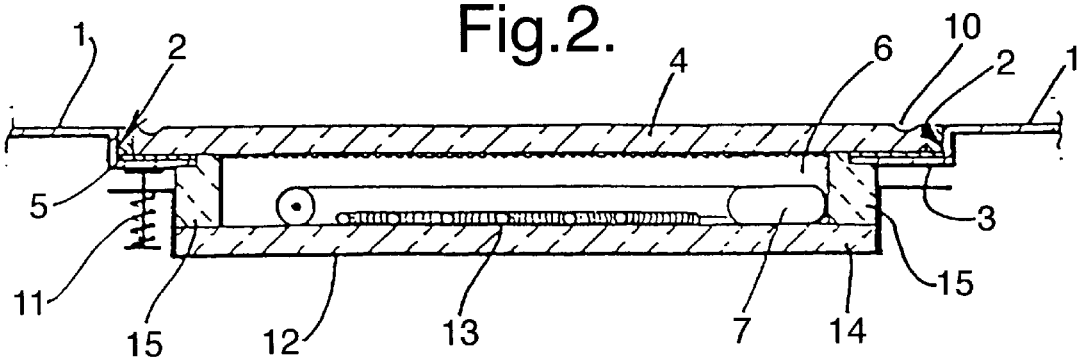
FIG. 2 is a cross-section along the line I—I of FIG. 1.

Referring to both FIGS. 1 and 2, the hob comprises a member 1 of vitreous enamelled steel having an aperture 2 therein. The steel around the edge of the aperture 2 is bent to form a shelf 3 on which is positioned a molded glass-ceramic insert 4 supported by means of an alumina/glass fibre and silicone mixture. The glass-ceramic insert comprises a lithium-alumino-silicate which has a working range in which it can be molded of 1200–1800° C.

Insert 4 has a Fresnel lens 6 molded onto its lower surface, seen in FIG. 2, which controls the dispersion of light from tungsten halogen lamp 7, and on its upper surface spillage retention channel 10. Energization of the lamp 7 is controlled in dependence on the electrical resistance of the lower surface of insert 4 which is determined by control circuitry (not shown) by measuring the resistive value of the glass between conductors 8*a* and 8*b*. These are platinum based electrodes formed by pad printing and processing an appropriate proprietary material, one suitable material being Cermet(™) Platinum Conductor marketed by E.S.L. (Europe). The conductors 8*a* and 8*b* are electrically connected at the edge of the insert 4 to control circuitry (not shown) by means of terminal 9.

Attached to the lip 3 of the member 1 are three resilient mounting means 11, each comprising a pin and captive spring, which urge upwards metal can 12, which houses tungsten halogen lamp 7 and additional wire wound heating elements 13. The metal can 12 is lined with thermally insulating material 14, a wall portion 15 of which is urged by means of the metal can 12 and resilient mounting means 11 into contact with the glass-ceramic insert 4. Further pressure on the glass-ceramic insert 4 by the wall 15 is prevented by the wall 15 coming into contact with the lip 3.

Figure 3:
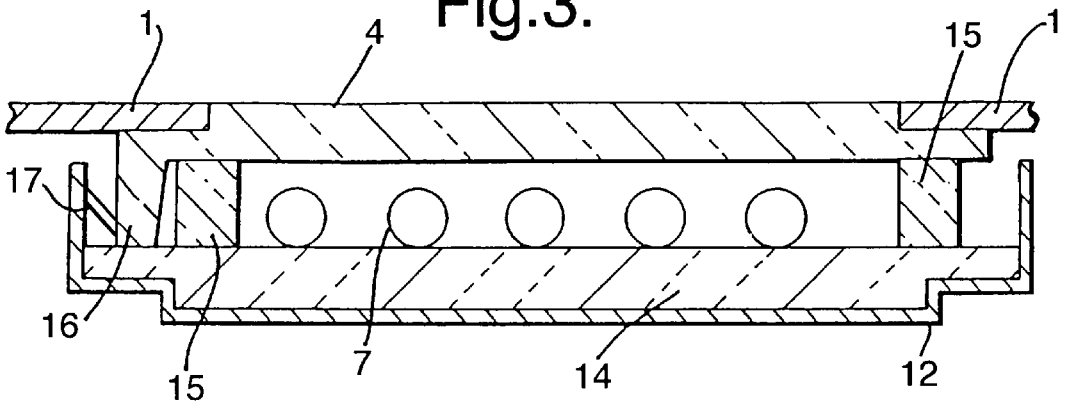
FIGS. 3 and 4 are alternative configurations of a hob in accordance with the present invention.

FIG. 3 shows schematically a second embodiment. In this arrangement the ceramic-glass insert 4 has three downwardly extending legs 16, only one of which is shown. These co-operate with a retention member 17 by which the insert is retained in the metal can 12 prior to mounting from underneath the member 1.

Figure 4:
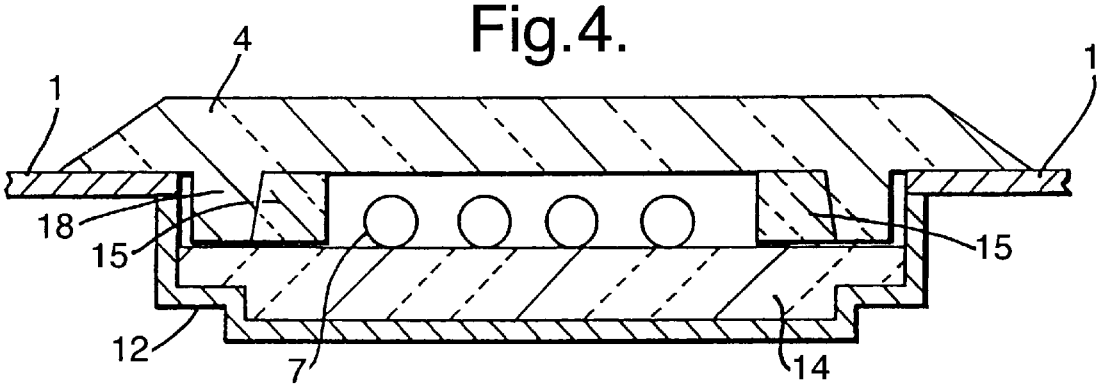

FIG. 4 illustrates an embodiment when the ceramic insert can be inserted into the member 1 from the top, with the metal can 12 already in position. A downwardly protruding skirt 18, molded in the insert 4, retaining the insulating ring 15 such that when inserted the ring 15, in conjunction with the layer of insulating material 14, provides a thermally insulated housing for the heating element 7.

Figure 5:
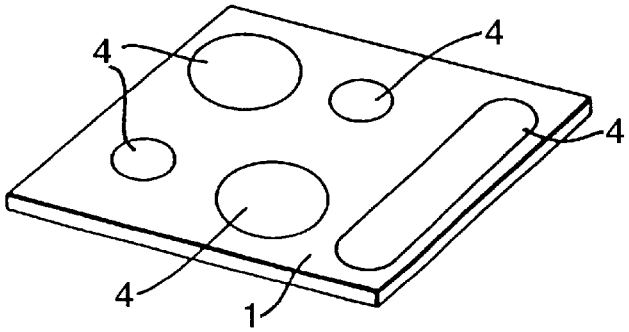
FIG. 5 is a perspective view of a hob of which FIGS. 1 and 2 or 3 of 4 depict a part.

FIG. 5 illustrates a complete hob which FIGS. 1 and 2 or FIG. 3 or FIG. 4, depict a part thereof. This hob comprises five hotplates, but it will be realized that any number and shape of hotplates could be employed in a hob in accordance with the invention.

Figure 6:
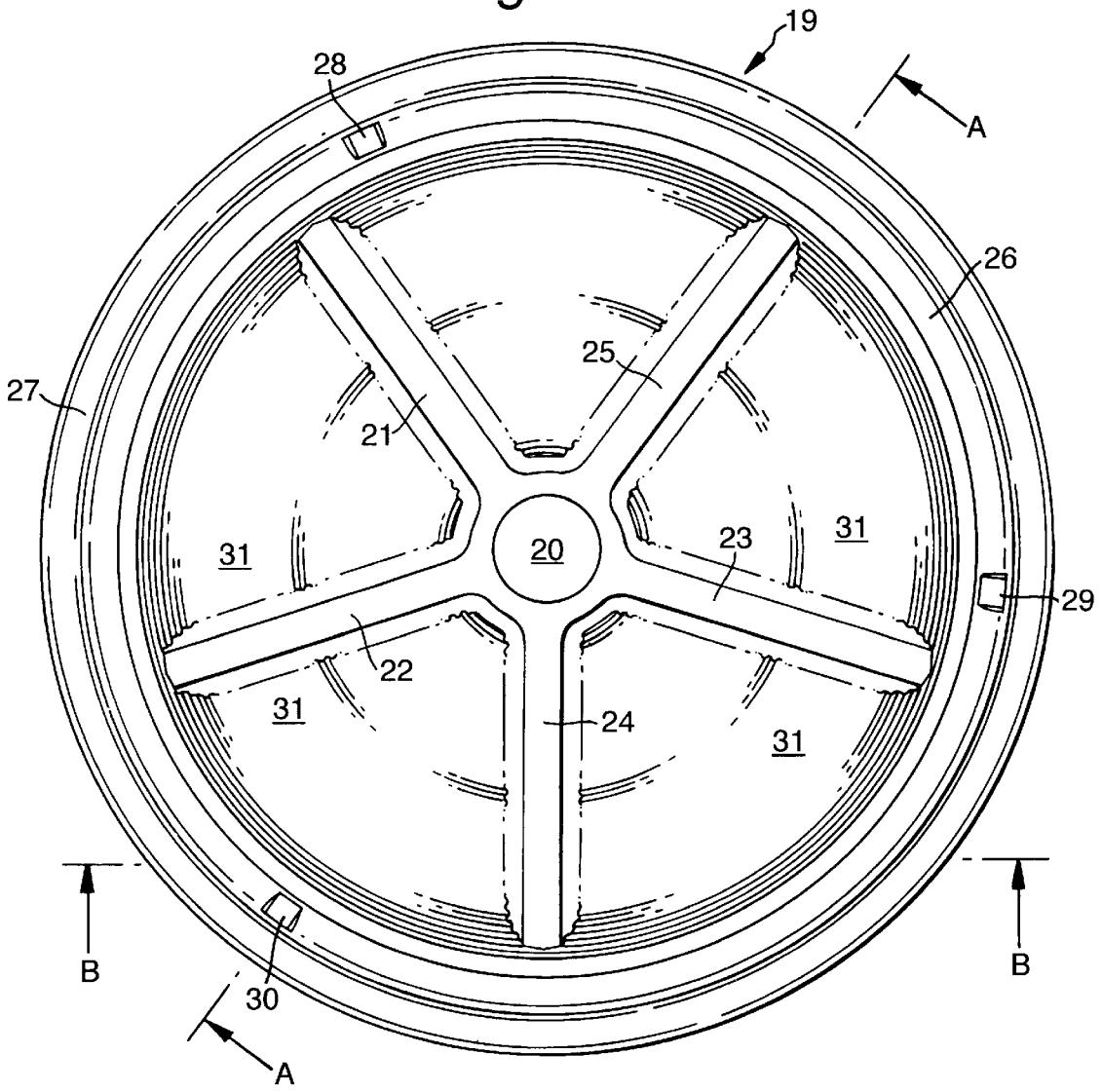
FIG. 6 shows in inverted plan view an improved glass-ceramic insert of a heating unit in accordance with second and third aspects of the present invention.
Figure 7:
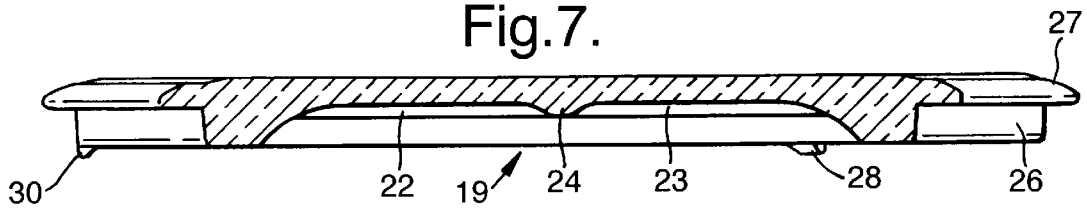
FIG. 7 shows section B—B of the glass-ceramic insert of FIG. 6.
Figure 8:
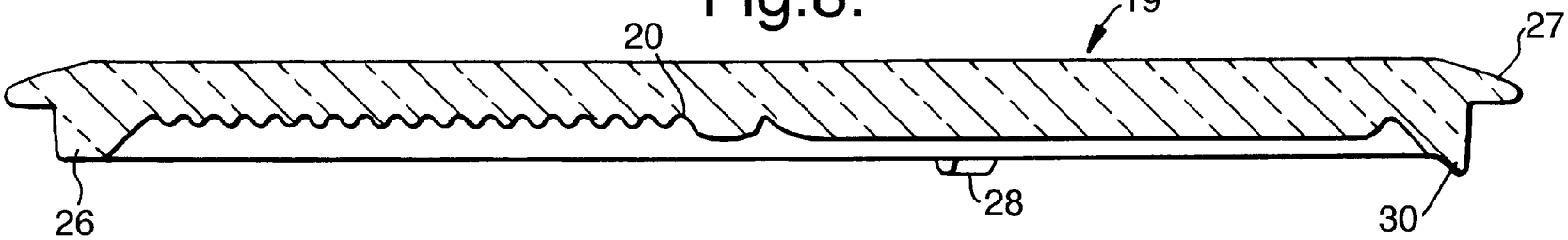
FIG. 8 shows section A—A of the glass-ceramic insert of FIG. 6.

Referring now to FIGS. 6, 7 and 8, a glass ceramic insert 19 of a heating unit in accordance with second and third aspects of the present invention is shown comprising a central node 20, reinforcing spars 21–25, a skirt 26, a flange 27 and lugs 28–30.

Insert 19 has a substantially planar upper surface, which constitutes a cooking surface. Flange 27 extends around the entire circumference of the insert 19 as does skirt 26. The lowermost surfaces of reinforcing spars 21–25 and central node 20 lie in a plane substantially parallel to that of the cooking surface. The spars 21–25 provide insert 19 with a substantially stronger structure than would be achieved by a uniform thickness insert having the same volume of glass. Thus, a glass-ceramic insert having the same strength as that of the inserts of the first two embodiments can be formed from less glass with the resultant reduction in weight and cost of manufacture.

Insert 19 is formed by pressing in a mold from a material such as a lithium-alumino-silicate. The areas 31 bordered by skirt 26 and the reinforcing spars 21–25 on the upper face of insert 19 have a surface pattern molded thereon to form a lens. This pattern comprises a series of concentric circles, originating from the geometric center of insert 19, and has a substantially sinusoidal profile. Such patterns are sometimes referred to as Fresnel lenses, although the pattern is not a true Fresnel lens as it is not optically precise and does not have a focal point. The lens formed by this pattern has the effect of preventing objects being seen clearly through the substantially transparent insert 19 and also acts to evenly disperse energy radiated through the insert.

Reinforcing of insert 19 is also provided by forming the lower surface of the insert with a relatively large radius curved surface abating skirt 26, as can be seen in FIG. 7.

Figure 10:
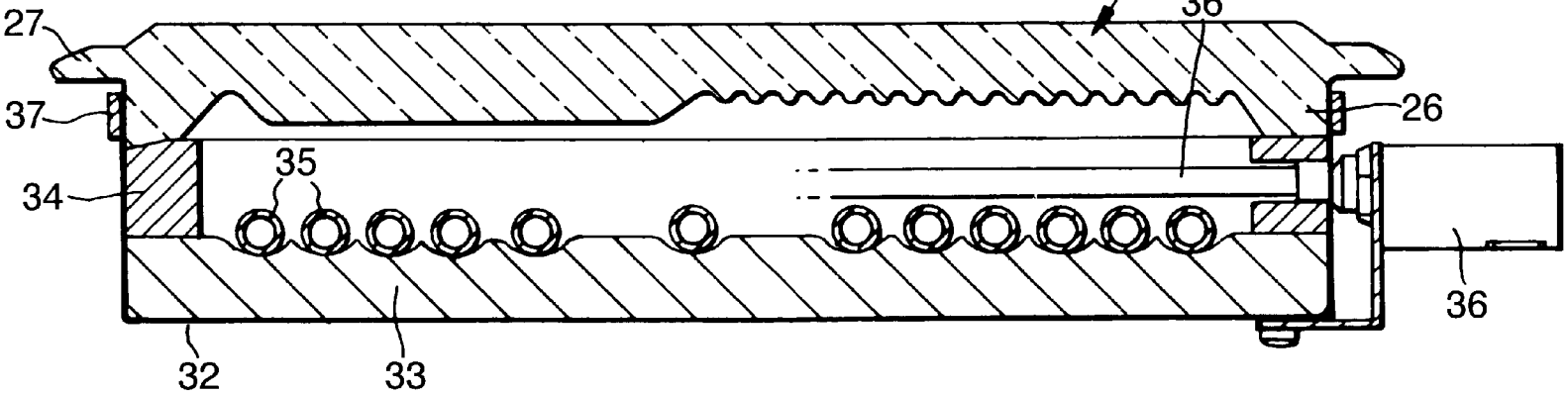
FIG. 10 shows section A—A of the heating unit of FIG. 9.
Figure 9:
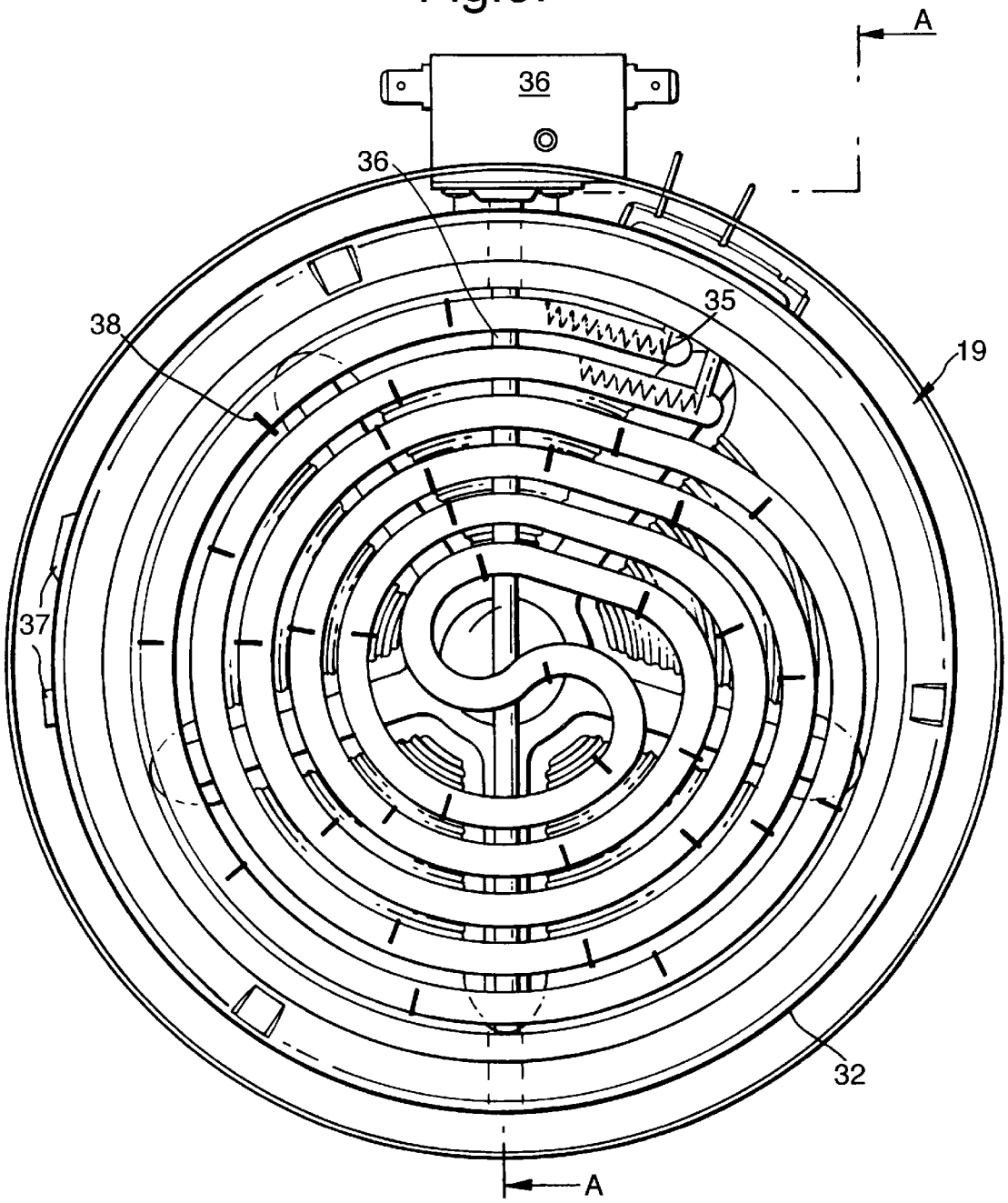
FIG. 9 shows a plan view of a heating unit in accordance with second and third aspects of the present invention.

Referring now to FIGS. 9 and 10, a heating unit in accordance with the second and third aspects of the present invention is shown comprising an insert 19, a metal can 32, a planar substrate 33, an annular spacer 34, a radiant heating element 35, a conventional over-temperature thermal limiter 36 and a compression band 37.

Substrate 33 is formed in the base of the metal can 32, the substrate 33 preferably having a continuous indentation formed on its uppermost surface for containing the coiled heating element 35, stapled to the substrate 33 by staples 38. The resilient annular spacer 34 separates substrate 33 from insert 19, the spacer 34 having a hole formed therein to allow the over-temperature thermal limiter 36 to extend into the space above heating element 35.

On assembly, the insert is pushed into the can 32 whereupon the lugs 28–30 latchingly engage with holes (not shown) in the sidewall of can 32. These holes preferably allow some downward movement of insert 19 in can 32 so that the resilience of spacer 34 can be used to provide an amount of shock absorbing movement between the can 32 and the insert 19. The compliance of the spacer also acts to maintain the insert 19 fixed relative to the can 32 by forcing the lugs 28–30 into contact with the uppermost edge of the holes in the can 32.

The metal band 37 is located on the outside surface of can 32 and forces can 32 against skirt 26 of insert 19. The metal band is held in tension by any suitable clamping arrangement, in turn keeping the insert in compression which greatly increases its resistance to breakage on impact. The metal band may be of the "gaiter clamp" type.

The hob element is secured, in use, to a sheet metal cooker top such as that shown in FIG. 5 by a seal (not shown) formed from a mixture of alumina/glass fibre and silicone sealant. This seal is located between the upper surface of the cooker top, which encircles can 32 or skirt 20, and the lowermost surface of flange 27.

We claim:

1. A heating unit for a hob comprising:

a container;

a radiant heating element positioned within the container; and a molded glass-ceramic insert having a substantially planar upper surface and a lower surface shaped to provide a plurality of substantially radially extending formations to reinforce the insert against damage from vertically applied forces.

2. The heating unit in accordance with claim 1, in which said lower surface is shaped so as to have a greater thickness of glass towards its periphery and a lesser thickness towards its center, wherein the transition from a greater to a lesser thickness is provided by a curved profile.

3. The heating unit in accordance with claim 1, in which said formations comprise a plurality of reinforcing spars.

4. The heating unit in accordance with claim 3, in which the reinforcing spars each extend from a central node toward the periphery of the insert.

5. The heating unit in accordance with claim 1, in which the insert is formed with a skirt on its lower surface, the outermost dimensions of the skirt being such as to fit the innermost dimensions of the container.

6. The heating unit in accordance with claim 5, wherein the insert comprises a plurality of protrusions extending from the skirt which protrusions latch in corresponding engagement portions formed in the container when the insert is inserted into the container.

7. The heating unit in accordance with claim 1, in which the heating element is mounted on a substrate at the bottom of the container.

8. The heating unit in accordance with claim 7; and further comprising an annular spacer positioned between the substrate and the insert, and adjacent to the container.

9. The heating unit in accordance with claim 8, in which shock absorbing movement between the insert and the substrate is allowed by virtue of the resilience of the spacer.

10. The heating unit as claimed in claim 1; and further comprising a metal band extending around a downwardly protruding skirt of the insert, which band is in tension.

11. The heating unit in accordance with claim 1, said lower surface having a downwardly protruding skirt formed thereon, and a metal band held in tension by such as to act to compress the skirt and thereby reinforce the insert against damage from vertically applied forces.

* * * * *